US006249977B1

(12) United States Patent
Knoop

(10) Patent No.: US 6,249,977 B1
(45) Date of Patent: Jun. 26, 2001

(54) SCISSORS

(76) Inventor: Heinz-Peter Knoop, Balkhauser Kotten, Solingen (DE), 42659

( * ) Notice: Subject to any disclaimer, the term of this patent is extended or adjusted under 35 U.S.C. 154(b) by 0 days.

(21) Appl. No.: 09/555,041

(22) PCT Filed: Dec. 3, 1998

(86) PCT No.: PCT/DE98/03567

§ 371 Date: May 24, 2000

§ 102(e) Date: May 24, 2000

(87) PCT Pub. No.: WO99/29475

PCT Pub. Date: Jun. 17, 1999

(30) Foreign Application Priority Data

Dec. 6, 1997 (DE) ..... 197 54 207

(51) Int. Cl.[7] ..... B26B 13/20; B26B 13/28
(52) U.S. Cl. ..... 30/232; 30/251; 30/341
(58) Field of Search ..... 30/232, 251, 341

(56) References Cited

U.S. PATENT DOCUMENTS

| | | | | |
|---|---|---|---|---|
| 1,262,303 | * | 4/1918 | Broadbooks | 30/341 X |
| 4,642,895 | * | 2/1987 | Gauvry | 30/341 |
| 4,742,617 | * | 5/1988 | Gauvry | 30/232 |
| 5,007,170 | * | 4/1991 | Mayama | 30/232 |
| 5,060,381 | * | 10/1991 | Taberlet | 30/232 |
| 5,109,608 | * | 5/1992 | Pracht | 30/232 X |
| 5,125,159 | * | 6/1992 | Brenton et al. | 30/232 |
| 5,463,814 | * | 11/1995 | Stowell et al. | 30/232 |
| 5,469,624 | * | 11/1995 | Brenton et al. | 30/232 |
| 5,517,761 | * | 5/1996 | Wang | 30/341 X |
| 5,781,999 | * | 7/1998 | Chang | 30/232 X |

FOREIGN PATENT DOCUMENTS

| | | | | |
|---|---|---|---|---|
| 2648384 | * | 12/1990 | (FR) | 30/232 |
| 188993 | * | 4/1964 | (SE) | 30/341 |

* cited by examiner

*Primary Examiner*—Charles Goodman
(74) *Attorney, Agent, or Firm*—Diller, Ramik & Wight

(57) ABSTRACT

Disclosed is a pair of scissors, more particularly a barber scissors, comprising two scissor halves (3 and 4) that are joined at an axis of rotation (2). Each half has a cutting blade (5 and 6) and a shank (7 and 8) with a grip. The grip of one of the scissor halves (3) has a T-shaped grip (9) with a web (13) that draws away from the shank (7), more or less perpendicularly, on the plane of the scissors and two opposite limbs (14 and 15) extending more or less in the longitudinal direction of the shank (7) on the end of the web (13) opposite to the shank (7). The T-shaped grip (9) can be dismounted (7) and can be displaced and fixed in the longitudinal direction of the shank of the first half (3). The grip of the other half (4) is fixed in the longitudinal direction of the shank (8).

9 Claims, 3 Drawing Sheets

SCISSORS

BACKGROUND OF THE INVENTION

The invention relates to a pair of scissors comprising two scissor halves joined at an axis of rotation, each of which has a cutting blade and a shank with a grip, where the grip of one scissor half is designed as a T-shaped grip with a web projecting roughly perpendicularly away from the shank in the plane of the scissors and with two opposite limbs extending more or less in the longitudinal direction of the shank on the end of the web facing away from the shank.

The grips provided on the scissor halves of a pair of scissors are usually adapted to the hand of the user in such a way that the one grip is guided by the thumb and the other grip by the other fingers of the hand. It is often sufficient to use the middle and ring fingers to guide the one scissor half.

A pair of scissors is known where the grip guided by the middle and ring fingers is of T-shaped design. When using these scissors, the web of the T-shaped grip is held between the middle and ring fingers. Due to the fact that the scissors can be manipulated very sensitively using the middle and ring fingers, it has proven advantageous to provide a web that can be grasped by these fingers. The scissor half can be precisely controlled via the web of the T-shaped grip.

One disadvantage of the known pair of scissors is that it cannot be adapted to different hand sizes and finger thicknesses.

The fixed grips of the two scissor halves very quickly cause painful pressure sores that can easily become infected, particularly in users whose hand deviates from the optimum hand size for these scissors.

SUMMARY OF THE INVENTION

The object of the invention is to design a pair of scissors which, while retaining the advantages of the known scissors, does not cause any pressure sores, even in frequent use, and can be guided accurately at all times. In addition, the scissors should be of simple design.

According to the invention, the object is solved in that the T-shaped grip can be adjusted and fixed in the longitudinal direction of the shank of the first scissor half and the grip of the other scissor half is fixed in the longitudinal direction of the shank, where the T-shaped grip is moulded to a handle section that is connected to the shank via a tongue-and-groove joint, the handle section of the T-shaped grip has a groove with two side walls, of which one wall has a through-hole for a screw that is aligned with a thread for the screw provided in the opposite side wall of the groove, and the shank, which is mounted in the groove of the handle section in sliding fashion, has a slot that is penetrated by the screw.

As a result of this design according to the invention, the relative position of the grips of the two scissor halves can be adjusted in the longitudinal direction such that an optimum grip position can always be set for hands of different size and the scissors always give the user an exact impression of the current scissor position during use.

In the event that the T-shaped grip is too small or too large for a user's hand, it can be removed and replaced by a T-shaped grip that fits.

The proposed connection between the handle section provided with the T-shaped grip and the shank ensures a simple design of the scissors. The two side walls of the groove of the handle section can be tightened towards one another with the help of the screw. In this context, the shank located in the groove is clamped by the side walls, thus forming a non-positive connection between the shank and the handle section of the T-shaped grip. The ends of the slot of the shank form stops for the screw that limit the adjustment range of the T-shaped grip, which can be adjusted in the longitudinal direction of the shank.

A pair of scissors with a grip connected to the shank by a tongue-and-groove joint that can be adjusted and fixed in the longitudinal direction of the shank is known from EP-A-0 244 829. The tongue is designed as a T-shaped Projection on the grip and engages a correspondingly shaped T-slot in the shank. The grip is fixed in the longitudinal direction of the shank by a locking screw running in the transverse direction that acts against the head of the T-shaped projection. The hole in the shank for the screw requires the shank to have a width that corresponds to that of the grip. In contrast, the pair of scissors according to the invention is based on a simpler design, since a flat shank can be used, such as is obtained with modern manufacturing methods for scissor blades, such as the punching method.

In order to improve the adaptability of the scissors to different hand shapes and hand sizes, and to avoid pressure sores, especially on the thumb of the guiding hand, the grip that is fixed in the longitudinal direction of the shank is designed as a rotating grip, which can be rotated about an axis running in the plane of the scissors and transverse to the longitudinal direction of the shank. The rotating grip improves the ergonomics of the scissors and prevents painful pressure sores on the thumb of the guiding hand.

For the sake of simplicity, the rotating grip is mounted on a handle section located on the shank. For this purpose, the handle section has an inside bearing, in which a bearing bolt mounted on the rotating grip can rotate. The variability of the proposed scissors can be enhanced if the rotating grip can be fixed in any desired rotational position. In a configuration of this kind, the rotating grip can be used in two operating modes, namely freely rotating or fixed in any desired rotational position. It can be set to the respective operating mode that is most expedient for the current application.

In order to be able to easily grasp the scissors with the thumb and to ensure effective guidance of the scissors, a rotation limiter is provided that restricts the rotational range of the rotating grip to an angular range.

In a preferred configuration, the rotation limiter displays a slot provided on the handle section, whose ends act as stops for a pin mounted on the rotating grip that projects into the slot. The user can guide the scissors particularly accurately by turning the rotating grip such that the pin contacts one of the two ends of the slot. In this position of the rotating grip, both the scissor half guided by the thumb and the one guided by the middle and ring finger are guided accurately. If the rotating grip is in a rotational position between the ends of the rotational range, the other scissor half provided with the T-shaped grip primarily takes over the function of guiding the scissors. However, if a rotational position of the rotating grip between the ends of the rotational range is also to permit very direct guidance by the thumb, the rotational grip can be fixed in this desired rotational position.

Expediently, the free end of the bearing bolt of the rotating grip passes through the handle section and a screw is screwed into this free end that fixes the rotating grip when screwed tight and permits the rotating grip to rotate when tightened only slightly.

The rotating grip is preferably of C-shaped design, if the thumb is to be easily inserted into the rotating grip.

Alternatively, the rotating grip can be designed as a closed grip eye, if great importance is attached to particularly effective guidance of the rotating grip.

BRIEF DESCRIPTION OF THE DRAWINGS

An example of the invention is illustrated below in a drawing and explained in detail based on the figures. The figures show the following.

DESCRIPTION OF THE PREFERRED EMBODIMENTS

Figure 1:
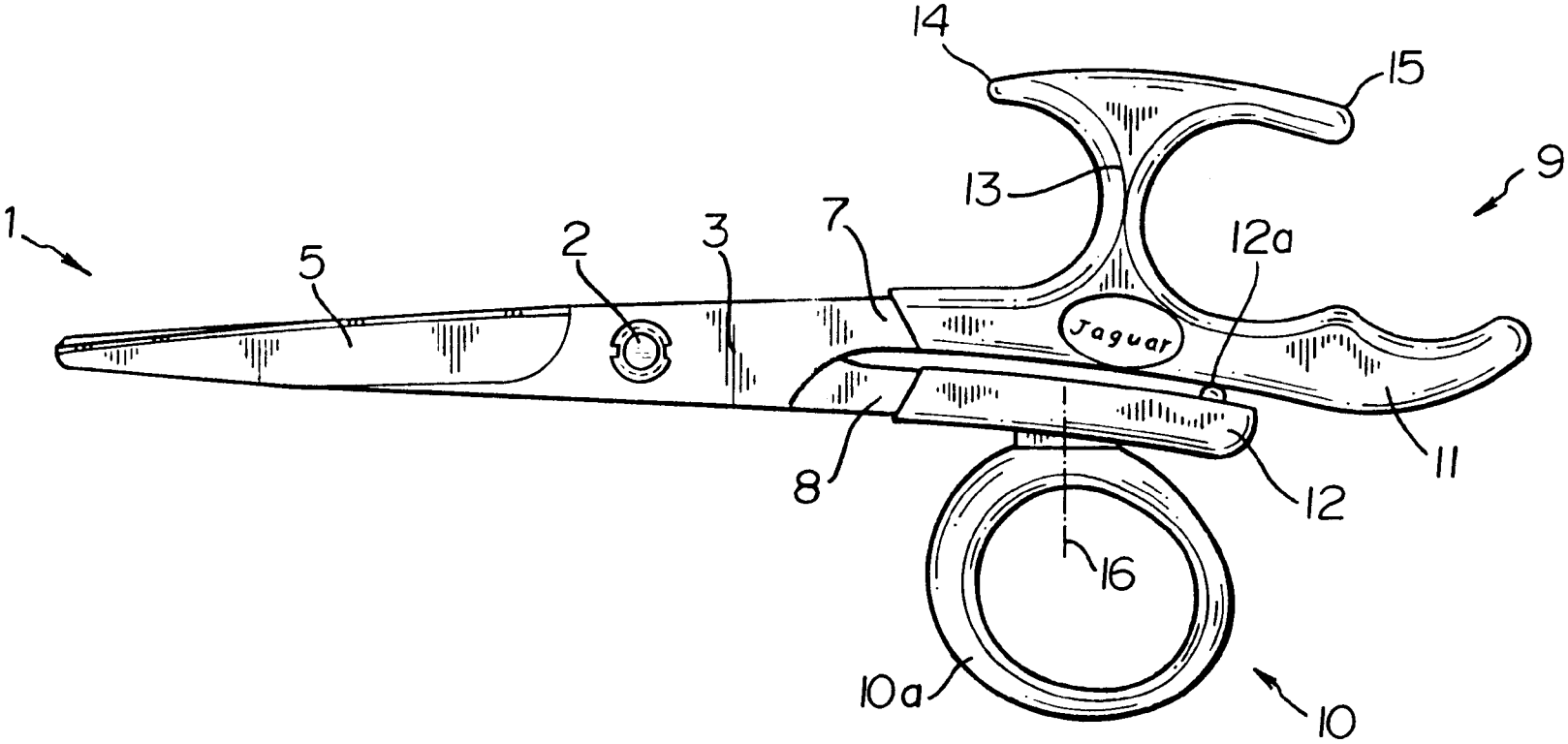
FIG. 1 A side view of the scissors.

According to FIG. 1 of the drawing, scissors 1 consist of two scissor halves 3 and 4 connected in an axis of rotation 2, each of which has a cutting blade 5 and 6 and a shank 7 and 8 with a grip.

Shanks 7 and 8 of each scissor half 3 and 4 are provided with handle sections 11 and 12 that each bear one of the grips. The grip of the one scissor half 3 is designed as a one-piece T-shaped grip 9 with a web 13 projecting roughly perpendicularly away from shank 7 in the plane of the scissors. The end of web 13 facing away from shank 7 has two opposite, limbs 14 and 15 extending roughly in the longitudinal direction of shank 7. The present T-shaped grip 9 is a one-piece plastic part. The grip of the other scissor half 4 is designed as a rotating grip 10 and can rotate about an axis 16 running in the plane of the scissors and transverse to the longitudinal direction of shank 8. Rotating grip 10 is also essentially made of plastic. Of course, T-shaped grip 9 and rotating drip 10 can also be made of a different material, such as a die-cast metal.

Figure 2:
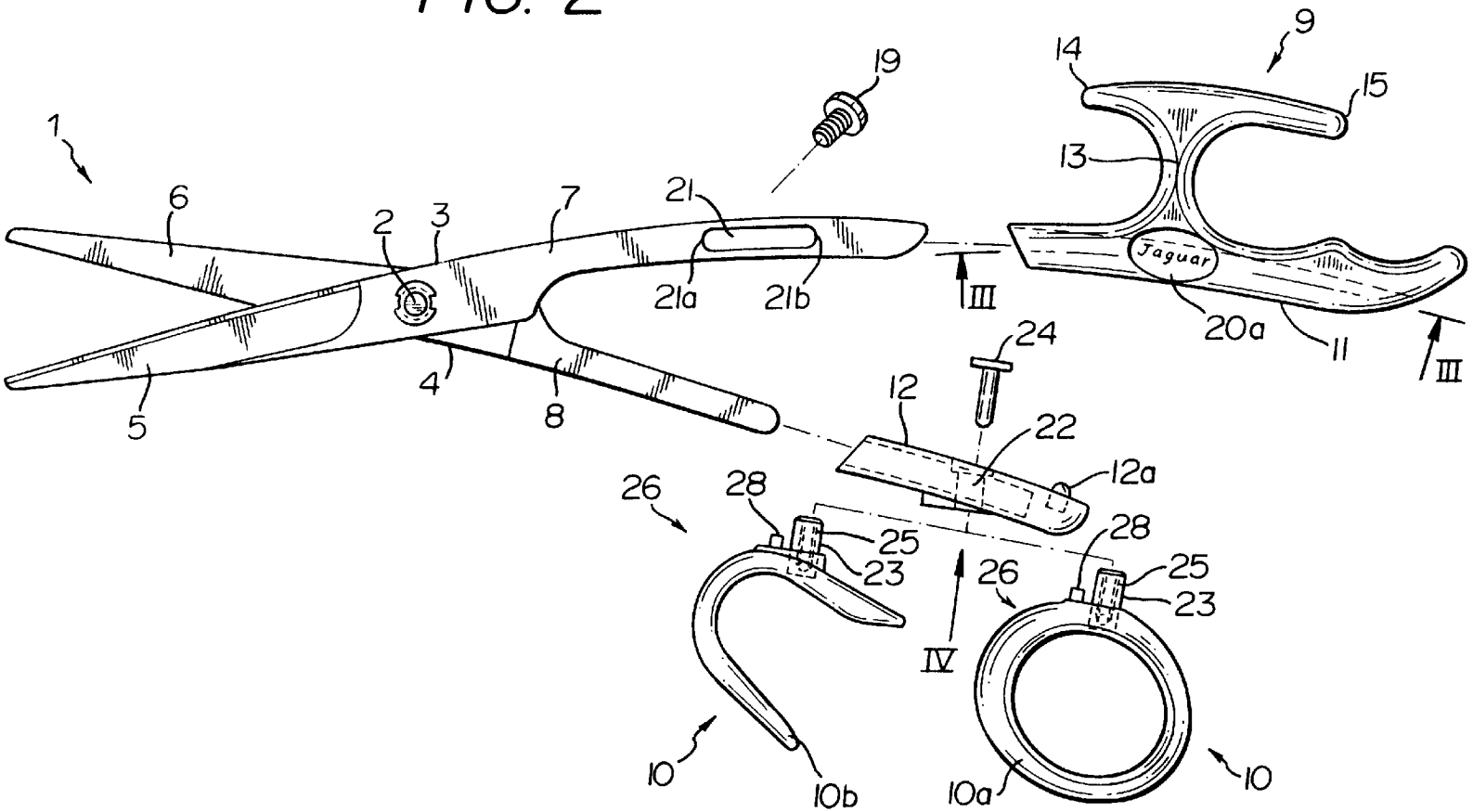
FIG. 2 A side view of the scissors in disassembled condition.

As shown in FIG. 2, T-shaped grip 9 can be removed and also adjusted and fixed in the longitudinal direction of shank 7 of the first scissor half 3. Adjustability is achieved by a tongue-and-groove joint between handle section 11 of T-shaped grip 9 and shank 7. Rotating grip 10 can be designed as a closed grip eye 10*a* or as a C-shaped grip 10*b* open on one side.

Figure 3:
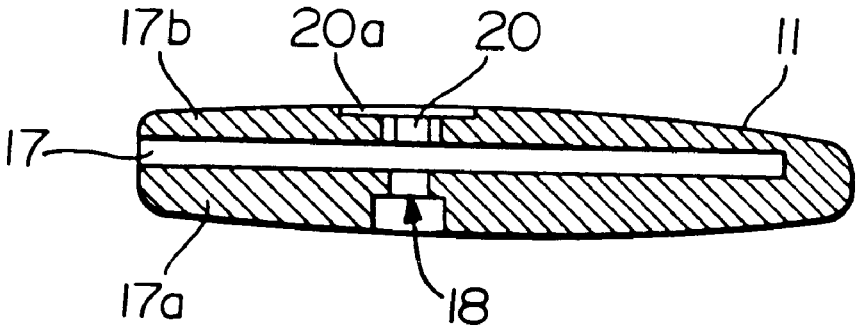
FIG. 3 A cross-sectional view of the handle section with T-shaped grip according to III—III in FIG. 2, and FIG. 4 A detail view of the handle section for the rotating grip according to IV in FIG. 2.

In the present configuration, handle section 11 of T-shaped grip 9 has the groove 17 and shank 7 forms the associated tongue. Groove 17 of handle section 11 has two parallel side walls 17*a* and 17*b*, as can be seen most clearly in FIG. 3. According to FIG. 3, one, side wall 17*a* of groove 17 has a through-hole 18 for a screw 19. A thread 20 for screw 19 is provided in the other side wall 17*b* of groove 17, in line with through-hole 18. In the configuration in FIG. 2, a cover plate 20*a* for thread 20 is provided on the outside of handle section 11 that prevents soiling and serves as a surface for a label.

FIG. 2 further shows that shank 7, which is mounted in groove 17 of handle section 11 in sliding fashion, has a slot 21 in the plane of the scissors that is penetrated by screw 19. Handle section 11 is connected to shank 7 in sliding fashion along the length of slot 21. In this context, the ends of slot 21 form stops 21*a* and 21*b* for screw 19 and limit the adjustment rage of T-shaped grip 9 along shank 7.

Handle section 11 of T-shaped grip 9, which is mounted on shank 7, can easily be shifted on shank 7 without screw 19. In order to fix it, screw 19 is inserted through the shank and screwed into thread 20 of side wall 17*b* of handle section 11. Due to the fact that side walls 17*a* and 17*b* of groove 17 are elastic, they are bent towards one another when screw 19 is tightened. In this way, shank 7 is clamped between side walls 17*a* and 17*b* of groove 17.

Rotating grip 10 is mounted in handle section 12 located on shank 8, handle section 12 being provided with inside bearing 22 for this purpose. Rotating grip 10 itself is provided with a bearing bolt 23, whose free end extends into inside bearing 22 and is thus pivot-mounted. Bearing bolt 23 of rotating grip 10 is fixed axially by a screw 24 screwed into the free end of bearing bolt 23, so that rotating grip 10 cannot come out of handle section 11 when using the scissors. To this end, bearing bolt 23 is equipped with a thread 25. Screw 24 can be screwed into thread 25 of bearing bolt 23 against slight resistance. Screw 24 is thus captive. According to the present configuration, rotating grip 10 essentially consists of plastic, as mentioned previously. Only bearing bolt 23 is made of metal. The rotating grip was moulded to metal bearing bolt 23 by an injection moulding process.

Rotating grip 10 can be fixed in any desired rotational position via rotation limiter 26. Rotation limiter 26 consists of an arc-shaped slot 27 provided on handle section 12 and a pin 28 mounted on rotating grip 10 that projects into slot 27.

Figure 4:
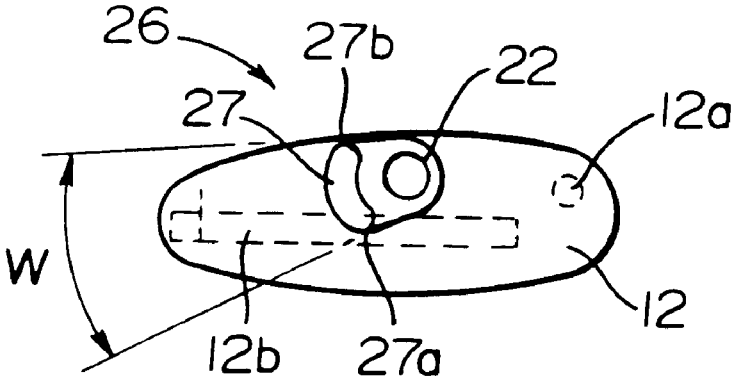

FIG. 4 shows a top view of handle section 12, in which inside bearing 22 and arc-shaped slot 27 of rotation limiter 26 are illustrated. The FIG. 4 also shows a stopper 12*a*, which acts as a stop for handle section 11 when scissor halves 3 and 4 are closed, and a recess 12*b*, in which shank 8 of scissor half 4 is inserted. The connection between shank 8 and handle section 12 is designed as a press fit. It can alternatively or additionally be designed as an adhesive connection. The center of the arc of arc-shaped slot 27 and rotational axis 16 of rotating grip 10 are concentric. In assembled condition, pin 28 of rotating grip 10 thus moves in a circular path that coincides with the centre line of slot 27.

The free end of bearing bolt 23 of rotating grip 10 nearly passes through handle section 12. Handle section 12 is mounted between rotating grip 10 and screw 24, screwed into the free end of bearing bolt 23, in such a way that a clamping effect can be produced by tightening screw 24. Rotating grip 10 can be fixed in any desired rotational position by firmly tightening screw 24. When screw 24 is tightened only slightly, it permits rotating grip 10 to rotate while the scissors are in use.

Furthermore, the ends of arc-shaped slot 27 of rotation limiter 26 form stops 27*a* and 27*b* for pin 28 of rotating grip 10. Stops 27*a* and 27*b* limit the rotational range of rotating grip to an angular range W defined by slot 27.

Although a preferred embodiment of the invention has been specifically illustrated and described herein, it is to be understood that minor variations may be made in the apparatus without departing from the spirit and scope of the invention, as defined the appended claims.

What is claimed is:

1. A pair of scissors comprising two scissor halves (3, 4) joined at an axis of rotation (2), each of said scissor halves (3, 4) has a cutting blade (5, 6) and a shank (7, 8) with a grip (9, 10), the grip (9) of one scissor half (3) is designed as a T-shaped grip (9) with a web (13) projecting substantially perpendicularly away from the shank (7) of the one scissor half in a plane of the scissors and blending with two opposite limbs (14, 15) extending substantially in a longitudinal direction of the shank (7) of the one scissor half on an end of the web (13) facing away from the shank (7) of the one scissor half; the T-shaped grip (9) can be removed, adjusted and fixed in the longitudinal direction of the shank (7) of the one scissor half (3),the grip (10) of the other scissor half (4) is fixed in a longitudinal direction of the shank (8) of the other scissor half, the T-shaped grip (9) is moulded to a handle section (11) slidably connected to the shank (7) of the one scissor half by a tongue-and-groove joint (7, 17), the handle section (11) of the T-shaped grip (9) has a groove (17) including two side walls (17*a*, 17*b*), one wall (17*a*) of said two side walls (17*a*, 17*b*) has a through-hole (18) for a screw (19) that is aligned with a tread (20) for the screw (19) provided in an opposite side wall (17*b*) of the two side walls (17*a*, 17*b*), and the shank (7) of the one scissor half, which is mounted in the groove (17) of the handle section (11) in sliding fashion, has a slot (21) that is spanned by the screw (19).

2. The pair of scissors as claimed in claim 1 wherein the grip (10) of the other scissor half (4) is a rotating grip which can be rotated about an axis (16) substantially transverse to the longitudinal direction of the shank (8) of the other scissor half.

3. The pair of scissors as claimed in claim 2 wherein the rotating grip (10) is mounted in a handle section (12) located on the shank (8) of the other scissor half.

4. The pair of scissors as claimed in claim 3 wherein the handle section (12) of the other scissor half has an inside bearing (22), and a bearing bolt (23) mounted on the rotating grip (10) is rotatable in the inside bearing (22).

5. The pair of scissors as claimed in claim 2 wherein the rotating grip (10) can be fixed in any one of several desired rotational positions.

6. The pair of scissors as claimed in claim 2 wherein a rotation limiter (26) is provided for restricting the rotation of the rotating grip (10) to an angular range (W).

7. The pair of scissors as claimed in claim 6 wherein the rotation limiter (26) includes a slot (27) provided on a handle section (12) of the other scissor half, said slot (27) having ends defining stops (27*a*, 27*b*) for a pin (28) mounted on the rotating grip (10) that projects into the slot (27).

8. The pair of scissors as claimed in claim 2 wherein the rotating grip (10) is a closed grip eye (10*a*).

9. The pair of scissors as claimed in claim 2 wherein the rotating grip (10) is an open C-shaped grip (10*b*).

* * * * *